US011514848B2

(12) United States Patent
Kim et al.

(10) Patent No.: US 11,514,848 B2
(45) Date of Patent: Nov. 29, 2022

(54) DISPLAY DEVICE AND DRIVING METHOD THEREOF

(71) Applicant: LG Display Co., Ltd., Seoul (KR)

(72) Inventors: MinKi Kim, Daegu (KR); JinSung Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/537,146

(22) Filed: Nov. 29, 2021

(65) Prior Publication Data

US 2022/0208089 A1 Jun. 30, 2022

(30) Foreign Application Priority Data

Dec. 31, 2020 (KR) ..... 10-2020-0189703

(51) Int. Cl.
*G09G 3/32* (2016.01)
*G09G 3/20* (2006.01)
*G09G 3/3275* (2016.01)

(52) U.S. Cl.
CPC ..... *G09G 3/32* (2013.01); *G09G 3/2096* (2013.01); *G09G 3/3275* (2013.01); *G09G 2310/0275* (2013.01); *G09G 2310/0291* (2013.01); *G09G 2320/0233* (2013.01); *G09G 2330/021* (2013.01)

(58) Field of Classification Search
CPC ..... G09G 3/32; G09G 3/2096; G09G 3/3275; G09G 2310/0275; G09G 2310/0291; G09G 2320/0233; G09G 2330/021
See application file for complete search history.

(56) References Cited

U.S. PATENT DOCUMENTS 6,995,758 B2 * 2/2006 Fukuda ..... G09G 3/3696 345/98
8,115,725 B2 * 2/2012 Shin ..... G09G 3/3607 345/99
8,217,884 B2 * 7/2012 Mizuno ..... G09G 5/008 345/99
8,368,637 B2 * 2/2013 Choi ..... G02B 6/0076 345/589
8,648,788 B2 * 2/2014 Bae ..... G09G 3/3648 345/204

(Continued)

OTHER PUBLICATIONS

Combined Search and Examination Report, United Kingdom Intellectual Property Office Patent Application No. GB2117859.5, dated May 18, 2022, 6 pages.

*Primary Examiner* — Michael J Jansen, II
(74) *Attorney, Agent, or Firm* — Fenwick & West LLP

(57) ABSTRACT

According to an aspect of the present disclosure, the display device includes a timing controller configured to output a power control signal for controlling a driving current to the data driver. The data driver includes a plurality of source driving integrated circuits (SDICs) which each supplies the data voltage to each of the plurality of active areas. The timing controller generates the power control signal depending on a difference value between comparison data which is the maximum data transition value between adjacent pixel rows disposed in each of the plurality of active areas and edge comparison data which is the maximum data transition value between adjacent pixel rows disposed in the plurality of edge active areas. Thus, it is possible to improve an image quality at a boundary between the active areas.

20 Claims, 8 Drawing Sheets

(56) References Cited

U.S. PATENT DOCUMENTS 8,659,612 B2 * 2/2014 Yamada ..... G09G 3/344 345/560
8,860,767 B2 * 10/2014 Yu ..... G09G 3/2003 327/530
9,460,675 B2 * 10/2016 Harada ..... G09G 3/3648
9,601,043 B2 * 3/2017 Hikichi ..... G09G 3/20
9,916,803 B2 * 3/2018 Hohjoh ..... G09G 3/3666
10,339,872 B2 * 7/2019 Park ..... G09G 3/3208
11,011,086 B2 * 5/2021 Park ..... G09G 3/3688
11,232,764 B2 * 1/2022 Masai ..... G09G 3/3677
11,328,683 B2 * 5/2022 Nagata ..... G09G 3/3688
11,386,852 B2 * 7/2022 Park ..... G09G 3/3291
2002/0044142 A1 * 4/2002 Fukuda ..... G09G 3/3696 345/204
2007/0018938 A1 1/2007 Wei et al.
2008/0158454 A1 * 7/2008 Shin ..... G09G 3/3607 349/36
2008/0192038 A1 * 8/2008 Liu ..... G09G 3/20 345/206
2008/0218507 A1 * 9/2008 Mizuno ..... G09G 5/008 345/418
2010/0007680 A1 * 1/2010 Yu ..... G09G 5/10 327/530
2010/0253696 A1 * 10/2010 Choi ..... G02F 1/133615 345/589
2011/0175865 A1 * 7/2011 Bae ..... G09G 3/3648 345/204
2012/0062579 A1 * 3/2012 Yamada ..... G09G 3/344 345/560
2014/0292840 A1 * 10/2014 Harada ..... G09G 3/3648 345/694
2015/0109348 A1 * 4/2015 Hikichi ..... G09G 3/3688 345/690
2016/0358574 A1 * 12/2016 Hohjoh ..... G09G 3/3666
2017/0004776 A1 * 1/2017 Park ..... G09G 3/3233
2019/0228713 A1 * 7/2019 Tamura ..... G09G 3/3266
2020/0051474 A1 * 2/2020 Park ..... G09G 3/3696
2021/0027720 A1 * 1/2021 Park ..... G09G 3/3266
2021/0104204 A1 * 4/2021 Masai ..... G09G 3/3696
2021/0193016 A1 * 6/2021 Pyun ..... G09G 3/2092
2021/0241711 A1 * 8/2021 Nagata ..... G09G 3/3688
2022/0180815 A1 * 6/2022 Kim ..... G09G 3/3275
2022/0208089 A1 * 6/2022 Kim ..... G09G 3/3688

* cited by examiner

1st LUT

| Threshold (CD) | SV1 |
|---|---|
| CD < Th 1 | 0 |
| Th 1 < CD ≤ Th 2 | 1 |
| Th 2 < CD ≤ Th 3 | 1 |
| Th 3 < CD ≤ Th 4 | 2 |
| Th 4 < CD ≤ Th 5 | 2 |
| Th 5 < CD ≤ Th 6 | 3 |
| Th 6 < CD ≤ Th 7 | 4 |
| Th 7 < CD ≤ Th 8 | 4 |
| Th 8 < CD | 4 |

2nd LUT

| Threshold (ECD) | SV2 |
|---|---|
| CD < Th 1 | 0 |
| Th 1 < CD ≤ Th 2 | 1 |
| Th 2 < CD ≤ Th 3 | 1 |
| Th 3 < CD ≤ Th 4 | 2 |
| Th 4 < CD ≤ Th 5 | 2 |
| Th 5 < CD ≤ Th 6 | 3 |
| Th 6 < CD ≤ Th 7 | 4 |
| Th 7 < CD ≤ Th 8 | 4 |
| Th 8 < CD | 4 |

3rd LUT

| DV | CV |
|---|---|
| 0 | 0 |
| 1 | 0 |
| 2 | 1 |
| 3 | 1 |
| 4 | 2 |

FIG. 5

DISPLAY DEVICE AND DRIVING METHOD THEREOF

CROSS-REFERENCE TO RELATED APPLICATIONS

This application claims the priority of Korean Patent Application No. 10-2020-0189703 filed on Dec. 31, 2020, in the Korean Intellectual Property Office, the disclosure of which is incorporated herein by reference.

BACKGROUND

Field

The present disclosure relates to a display device and a driving method thereof, and more particularly, to a display device that can control a driving current.

Description of the Related Art

Display devices employed by the monitor of a computer, a TV, a mobile phone or the like include an organic light emitting display (OLED) that emits light by itself, and a liquid crystal display (LCD) that requires a separate light source.

Among such various display devices, the OLED includes a display panel including a plurality of sub-pixels and drivers for driving the display panel. The drivers include a gate driver configured to supply gate voltages to the display panel and a data driver configured to supply data voltages. When a signal, such as a gate voltage and a data voltage, is supplied to a sub-pixel of the OLED, the selected sub-pixel emits light to display an image.

The data driver includes a plurality of source driving integrated circuits (SDICs), and each of the SDICs supplies a data voltage to each of a plurality of active areas.

Further, at a boundary between an active area controlled by an SDIC where data transition occurs frequently and an active area controlled by an SDIC where data transition does not occur, a defect such as a block dim may occur. This may be caused by a difference in driving current between the SDICs even when data voltages for representing the same gray scale are applied.

SUMMARY

An object to be achieved by the present disclosure is to provide a display device capable of reducing a block dim between a plurality of active areas, and a driving method thereof.

Another object to be achieved by the present disclosure is to provide a display device capable of reducing power consumption by adjusting a driving current, and a driving method thereof.

Objects of the present disclosure are not limited to the above-mentioned objects, and other objects, which are not mentioned above, can be clearly understood by those skilled in the art from the following descriptions.

According to an aspect of the present disclosure, the display device includes a display panel that is divided into a plurality of active areas. Further, the display device includes a data driver configured to supply data voltages to a plurality of pixels disposed in each of the plurality of active areas. Also, the display device includes a timing controller configured to output, to the data driver, a power control signal for controlling a driving current. Each of active area is divided into a center active area where a plurality of pixel columns is disposed at a central portion among a plurality of pixel columns disposed in the active areas, and one or more edge active areas where a plurality of pixel columns is disposed at an outer portion among the plurality pixel columns disposed in the active area. The data driver includes a plurality of source driving integrated circuits (SDICs) which each supplies the data voltage to each of the plurality of active areas. The timing controller generates the power control signal depending on a difference value between comparison data which is the maximum data transition value between adjacent pixel rows disposed in each of the plurality of active areas and edge comparison data which is the maximum data transition value between adjacent pixel rows disposed in the plurality of edge active areas. Thus, it is possible to improve an image quality at a boundary between the active areas.

According to another aspect of the present disclosure, the driving method of a display device includes a data delay process for delaying video data by one horizontal period and outputting the delayed video data. Further, the driving method includes a data comparison process for generating comparison data and edge comparison data by comparing the video data and the delayed video data. Also, the driving method includes a first reference value setting process for setting a first reference value by applying the comparison data to a first look-up table $1^{st}$ LUT. Furthermore, the driving method includes a second reference value setting process for setting a second reference value by applying the edge comparison data to a second look-up table $2^{nd}$ LUT. Moreover, the driving method includes a compensation value calculation process for setting a compensation value by applying a difference value between a first reference value corresponding to an active area and a second reference value corresponding to an edge active area adjacent to the active area to a third look-up table $3^{rd}$ LUT. Further, the driving method includes a power control signal output process for adding the compensation value to the first reference value corresponding to the active area and outputting a result as the power control signal.

Other detailed matters of the exemplary embodiments are included in the detailed description and the drawings.

According to the present disclosure, it is possible to suppress a block dim at a boundary between a plurality of active areas when data voltages for representing the same gray scale are applied to the plurality of active areas.

According to the present disclosure, it is possible to determine an optimal driving power for each active area and thus optimize power consumption of a display device.

The effects according to the present disclosure are not limited to the contents exemplified above, and more various effects are included in the present specification.

BRIEF DESCRIPTION OF THE DRAWINGS

The above and other aspects, features and other advantages of the present disclosure will be more clearly understood from the following detailed description taken in conjunction with the accompanying drawings, in which:

FIG. 5 illustrates a look-up table (LUT) of a power control signal generator of the display device according to an embodiment of the present disclosure;

DETAILED DESCRIPTION OF THE EMBODIMENT

Figure 1:
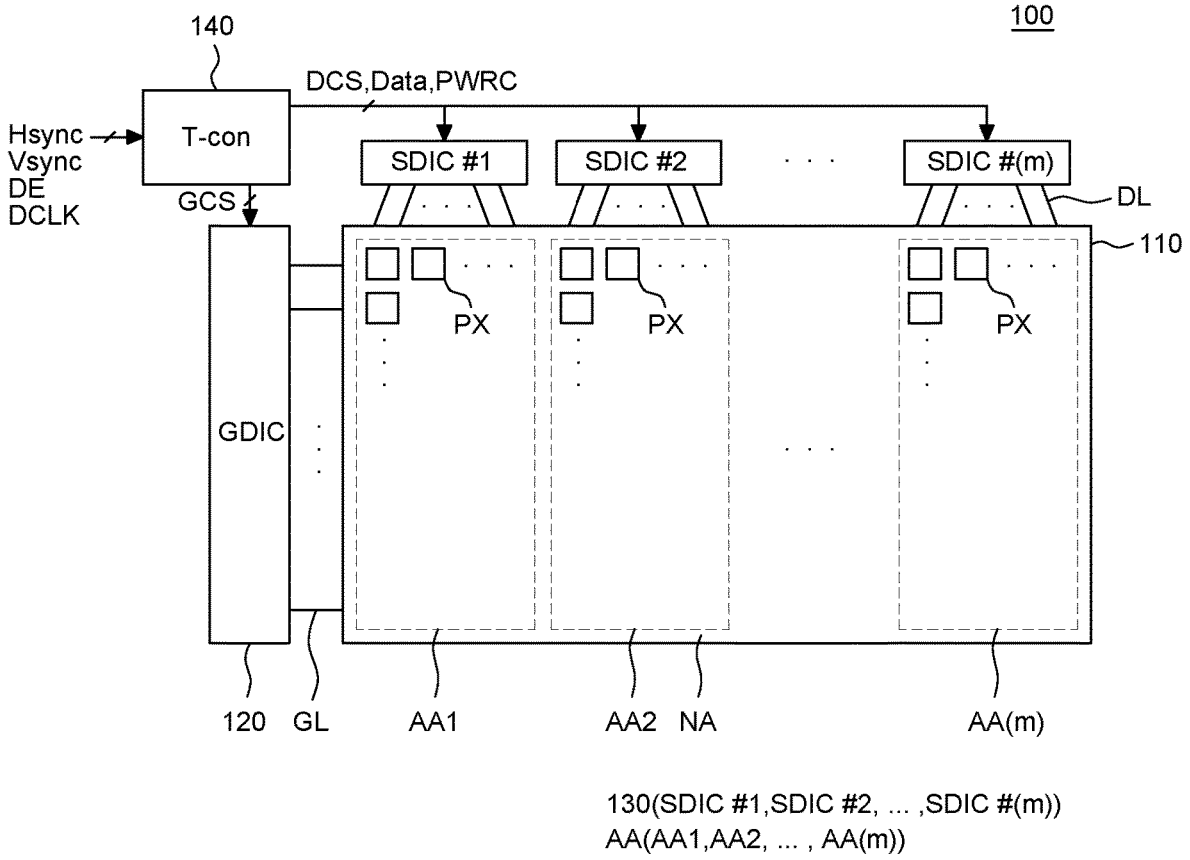
FIG. 1 is a schematic diagram illustrating a display device according to an embodiment of the present disclosure.

The advantages and features of the present disclosure, and methods for accomplishing the same will be more clearly understood from exemplary embodiments described below with reference to the accompanying drawings. However, the present disclosure is not limited to the following exemplary embodiments but may be implemented in various different forms. The exemplary embodiments are provided only to complete disclosure of the present disclosure and to fully provide a person with ordinary skill in the art to which the present disclosure pertains with the category of the present disclosure, and the present disclosure will be defined by the appended claims.

The shapes, dimensions, ratios, angles, numbers, and the like illustrated in the accompanying drawings for describing the exemplary embodiments of the present disclosure are merely examples, and the present disclosure is not limited thereto. Like reference numerals generally denote like elements throughout the specification. Further, in the following description of the present disclosure, a detailed explanation of known related technologies may be omitted to avoid unnecessarily obscuring the subject matter of the present disclosure. The terms such as "including," "having," and "consist of" used herein are generally intended to allow other components to be added unless the terms are used with the term "only". Any references to singular may include plural unless expressly stated otherwise.

Components are interpreted to include an ordinary error range even if not expressly stated.

When the position relation between two parts is described using the terms such as "on", "above", "below", and "next", one or more parts may be positioned between the two parts unless the terms are used with the term "immediately" or "directly".

When an element or layer is referred to as being "on" another element or layer, it may be directly on the other element or layer, or intervening elements or layers may be present.

Although the terms "first", "second", and the like are used for describing various components, these components are not confined by these terms. These terms are merely used for distinguishing one component from the other components. Therefore, a first component to be mentioned below may be a second component in a technical concept of the present disclosure.

Throughout the whole specification, the same reference numerals denote the same elements.

Since the dimensions and thickness of each component illustrated in the drawings are represented for convenience in explanation, the present disclosure is not necessarily limited to the illustrated dimensions and thickness of each component.

The features of various embodiments of the present disclosure can be partially or entirely coupled to or combined with each other and can be interlocked and operated in technically various ways, and the embodiments can be carried out independently of or in association with each other.

Hereinafter, various exemplary embodiments of the present disclosure will be described in detail with reference to the accompanying drawings.

FIG. 1 is a schematic diagram illustrating a display device according to an embodiment of the present disclosure. Referring to FIG. 1, a display device 100 includes a display panel 110, a gate driver 120, a data driver 130 and a timing controller 140.

The display panel 110 is a panel for displaying images. The display panel 110 may include various circuits, lines, and light emitting elements disposed on a substrate. The display panel 110 is divided by a plurality of data lines DL and a plurality of gate lines GL intersecting one another, and may include a plurality of pixels PX connected to the plurality of data lines DL and the plurality of gate lines GL.

The display panel 110 may include a plurality of active areas AA defined by the plurality of pixels PX and a non-active area NA where various signal lines, pads, etc. are formed. The plurality of active areas AA may be divided into a first active area AA1 to an mth active area AA(m).

Each of the plurality of pixels PX may include a plurality of sub-pixels. The plurality of sub-pixels may emit different colors. For example, each of the plurality of sub-pixels may be a red sub-pixel, a green sub-pixel and a blue sub-pixel, but is not limited thereto. The plurality of sub-pixels may form a pixel PX. That is, a red sub-pixel, a green sub-pixel and a blue sub-pixel may form a pixel PX, and the display panel 110 may include a plurality of pixels PX.

The display panel 110 may be implemented as a display panel used in various display devices such as a liquid crystal display device, an organic light emitting display device and an electrophoretic display device.

The timing controller 140 receives timing signals, such as a vertical synch signal (Vsync), a horizontal synch signal (Hsync), a data enable signal (DE) and a data clock signal (DCLK), via a receiving circuit such as LVDS and TMDS interfaces connected to a host system. The timing controller 140 generates control signals DCS and GCS for controlling the data driver 130 and the gate driver 120 based on the received timing signals.

For example, the timing controller 140 outputs various gate control signals GCS including a gate start pulse, a gate shift clock and a gate output enable signal to control the gate driver 120.

In some embodiments, the gate start pulse controls an operation start timing of the gate driver 120. The gate shift clock is a clock signal which is commonly input to one or more gate circuits and controls a shift timing of a gate voltage. The gate output enable signal designates output timing information of the gate driver 120.

The timing controller 140 outputs various data control signals DCS including a source start pulse, a source sampling clock and a source output enable signal to control the data driver 130.

In some embodiments, the source start pulse controls a data sampling start timing of one or more source driving integrated circuits (SDICs) which form the data driver 130. The source sampling clock is a clock signal which controls a sampling timing of data in the data driver 130. The source output enable signal controls an output timing of the data driver 130.

Further, the timing controller 140 transmits digital video data Data to the data driver 130. The digital video data Data is converted into an analog data voltage by the data driver 130 and then output to each pixel PX disposed in the active areas AA.

Furthermore, the timing controller 140 outputs a power control signal PWRC to the data driver 130. The power control signal PWRC can control a driving current of one or more SDICs that form the data driver 130.

The gate driver 120 supplies gate voltages to the plurality of pixels PX. The gate driver 120 may include a plurality of stages for shifting gate voltages to output the gate voltages in response to the gate control signals GCS. The plurality of stages included in the gate driver 120 may sequentially output gate voltages to the plurality of pixels PX through the gate lines GL. The gate driver 120 may be a gate driving integrated circuit (GDIC) formed in the non-active area NA of the display panel 110 by using a gate-in-panel (GIP) technique but is not limited thereto.

The data driver 130 supplies data voltages to the plurality of pixels PX. The data driver 130 may include a plurality of SDICs. That is, as shown in FIG. 1, the data driver 130 may include a first SDIC SDIC #1 configured to supply a data voltage to the first active area AA1, a second SDIC SDIC #2 configured to supply a data voltage to a second active area AA2, and an mth SDIC SDIC #(m) configured to supply a data voltage to the mth active area AA(m).

Each of the SDICs SDIC #1, SDIC #2, . . . , SDIC #(m) may be supplied with the digital video data Data, the data control signal DCS and the power control signal PWRC from the timing controller 140. Each of the SDICs SDIC #1, SDIC #2, . . . , SDIC #(m) may convert the digital video data Data into a data voltage by using an analog gamma voltage in response to the data control signal DCS. Also, each of the SDICs SDIC #1, SDIC #2, . . . , SDIC #(m) may drive the plurality of pixels PX through the data lines DL by adjusting a driving current in response to the power control signal PWRC.

The plurality of SDICs SDIC #1, SDIC #2, . . . , SDIC #(m) may be connected to the data lines DL of the display panel 110 by a chip-on-glass (COG) process or a tape automated bonding (TAB). In some embodiments, the plurality of SDICs SDIC #1, SDIC #2, . . . , SDIC #(m) may be formed on the display panel 110, or may be formed on a separate PCB and connected to the display panel 110.

Figure 2:
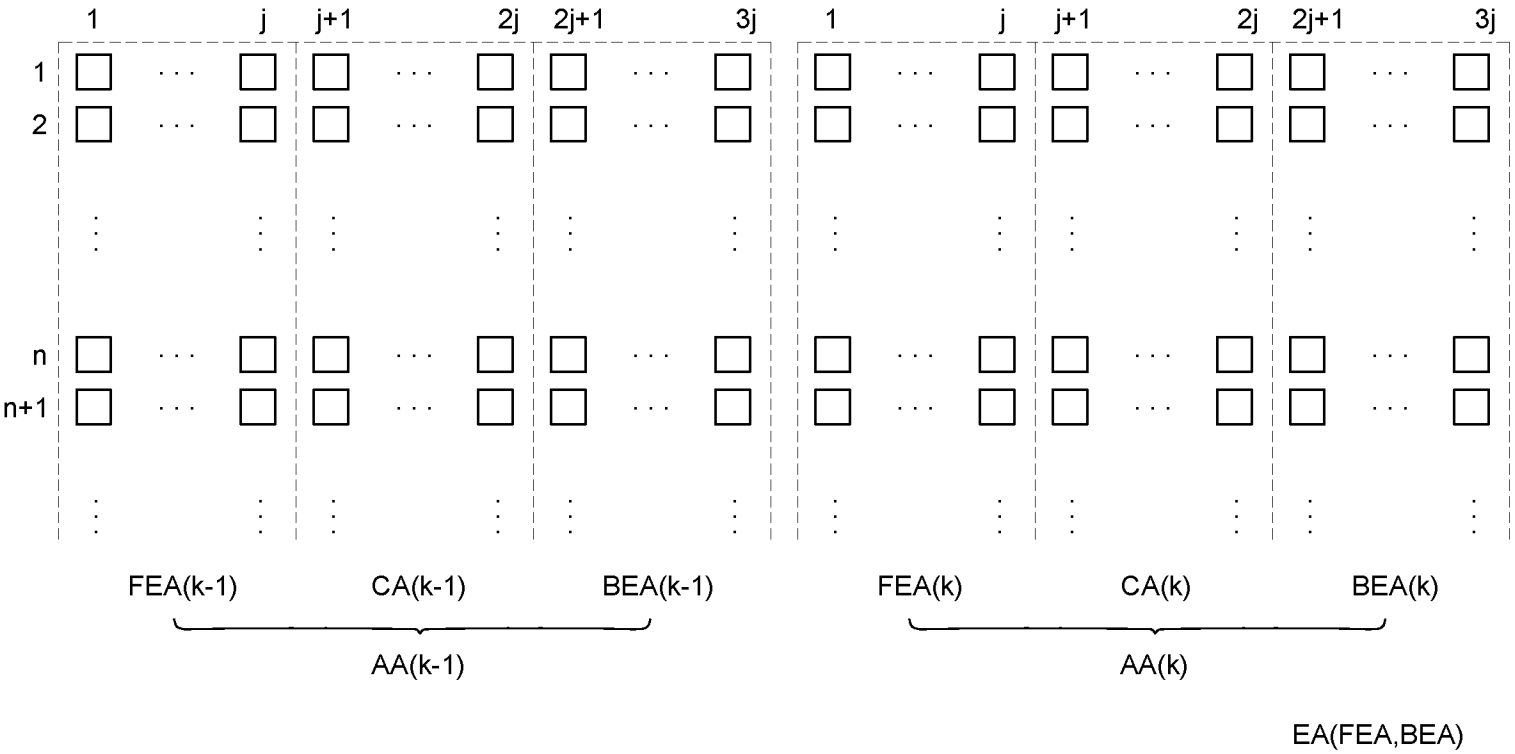
FIG. 2 is a diagram provided to explain a plurality of active areas of the display device according to an embodiment of the present disclosure.

FIG. 2 is a diagram provided to explain a plurality of active areas of the display device according to an embodiment of the present disclosure.

Each of the plurality of active areas AA may be divided into a center active area CA and one or more edge active areas EA.

The center active area CA refers to an area where a plurality of pixel columns is disposed at a central portion among a plurality of pixel columns disposed in each of the plurality of active areas AA.

Further, the edge active area EA refers to an area where a plurality of pixel columns is disposed at an outer portion among the plurality pixel columns disposed in each of the plurality of active areas AA.

The edge area EA may include a front edge active area FEA adjacent to a previous active area AA and a back edge active area BEA adjacent to a next active area AA. That is, the front edge active area FEA of a given active area AA refers to an area where a plurality of pixel columns is disposed at one side adjacent to the previous active area AA among the plurality pixel columns disposed in each of the plurality of active areas AA (e.g., disposed between the previous active area AA(k−1) and the center active area CA of the given active area AA(k)). Moreover, the back edge active area BEA of the given active area AA refers to an area where a plurality of pixel columns is disposed at the other side adjacent to the next active area AA among the plurality pixel columns disposed in each of the plurality of active areas AA (e.g., disposed between the center active area CA of the given active area AA(k) and the next active area AA(k+1)).

Thus, the back edge active area BEA of the previous active area AA may be adjacent to the front edge active area FEA of the next active area AA. For example, the front edge active area FEA of active area AA(k+1) is adjacent to the back edge active area BEA of active area AA(k). Similarly, the back edge active area BEA of active area AA(k−1) is adjacent to the front edge active area FEA of active area AA(k).

For example, as shown in FIG. 2, in a kth active area AA(k), a first pixel column to a jth pixel column are disposed in a kth front edge active area FEA(k). Furthermore, a j+1th pixel column to a 2jth pixel column are disposed in a kth center active area CA(k), and a 2j+1th pixel column to a 3jth pixel column are disposed in a kth back edge active area BEA(k).

Similarly, in a k−1th active area AA(k−1), the first pixel column to the jth pixel column are disposed in a k−1th front edge active area FEA(k−1), the j+1th pixel column to the 2jth pixel column are disposed in a k−1th center active area CA(k−1), and the 2j+1th pixel column to the 3jth pixel column are disposed in a k−1th back edge active area BEA(k−1).

In the example of FIG. 2, the k−1th back edge active area BEA(k−1) and the kth front edge active area FEA(k) are adjacent to each other.

In some embodiments, the first active area AA1 does not have a previous active area, and thus, a first front edge active area is not present. in addition, the mth active area AA(m) as the last active area does not have a next active area, and thus, an mth back edge active area is not present.

Figure 3:
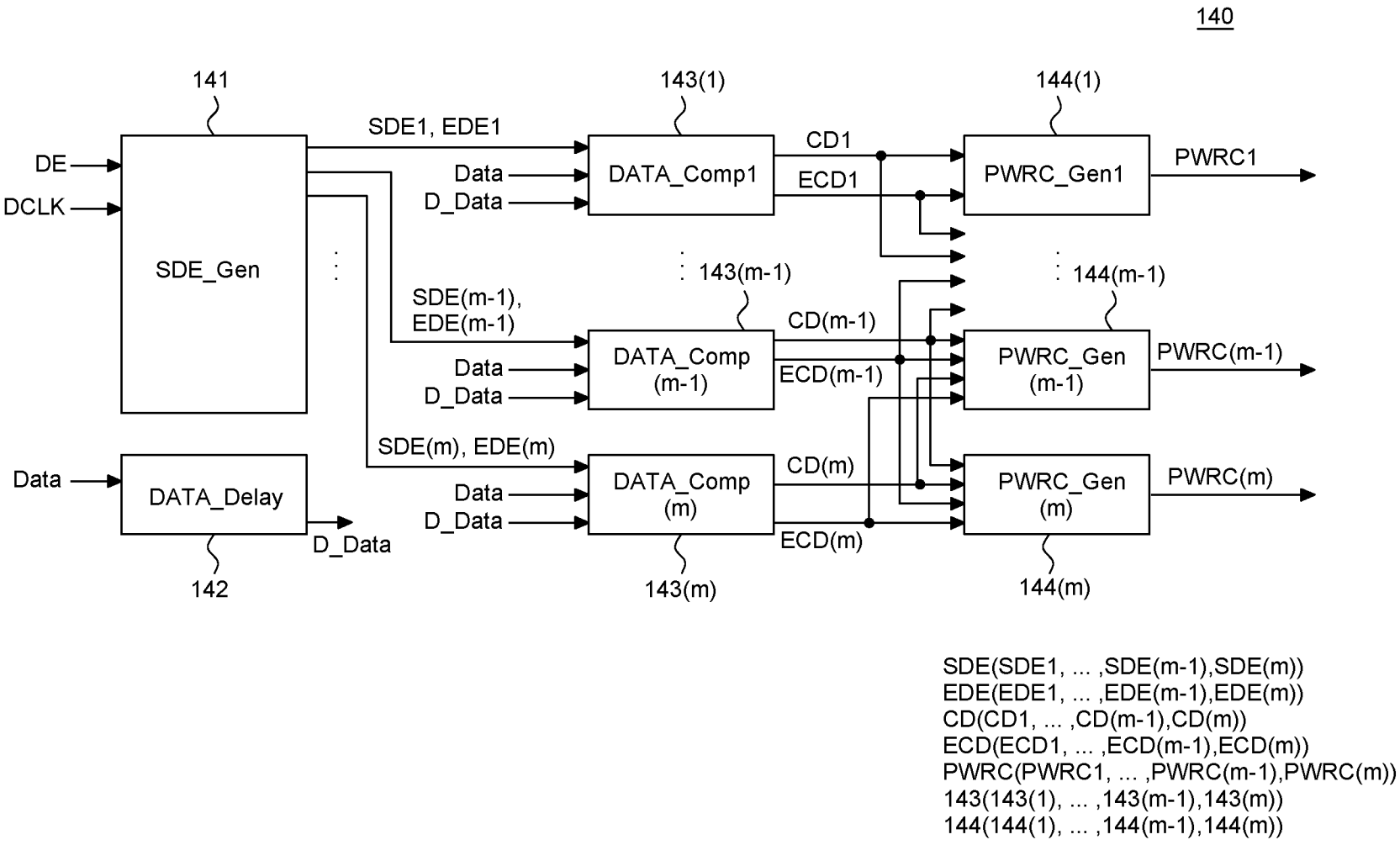
FIG. 3 is a diagram provided to explain a timing controller of the display device according to an embodiment of the present disclosure.

FIG. 3 is a diagram provided to explain a timing controller of the display device according to an embodiment of the present disclosure.

Figure 4:
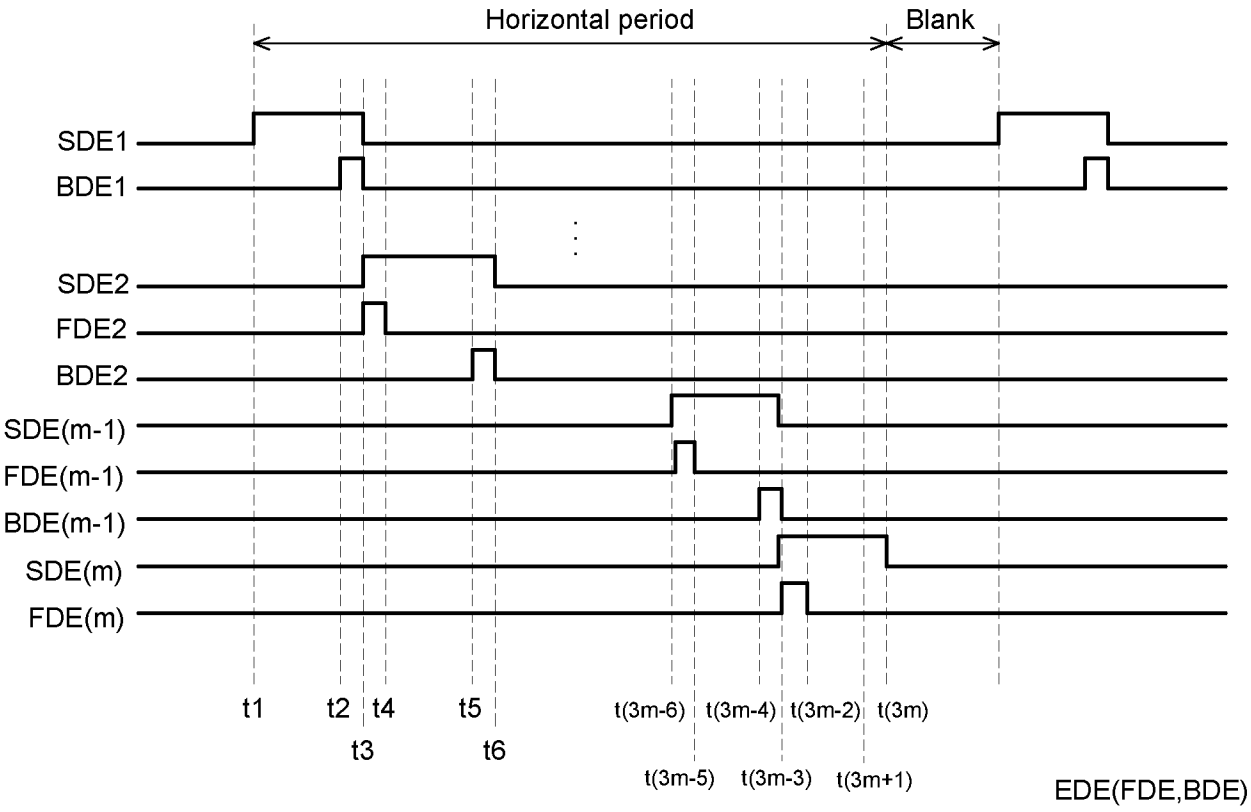
FIG. 4 is a waveform chart showing a sub-data enable signal and an edge data enable signal of the display device according to an embodiment of the present disclosure.

FIG. 4 is a waveform chart showing a sub-data enable signal and an edge data enable signal of the display device according to an embodiment of the present disclosure.

The timing controller 140 includes a data enable signal generator 141, a data delay unit 142, a plurality of data comparison units 143 and a plurality of power control signal generators 144.

The data enable signal generator 141 receives the DE and the DCLK signals, and outputs a sub-data enable signal SDE and an edge data enable signal EDE to each data comparison unit 143 in synchronization with the DE and the DCLK.

For example, as shown in the diagram of FIG. 3, the data enable signal generator 141 outputs a first sub-data enable signal SDE1 and a first edge data enable signal EDE1 to a first data comparison unit 143(1). Additionally, the data enable signal generator 141 outputs an m−1th sub-data enable signal SDE(m−1) and an m−1th edge data enable signal EDE(m−1) to an m−1th data comparison unit 143 (*m*−1). Furthermore, the data enable signal generator 141 outputs an mth sub-data enable signal SDE(m) and an mth edge data enable signal EDE(m) to an mth data comparison unit 143(*m*).

As shown in FIG. 4, the first sub-data enable signal SDE1 to the mth sub-data enable signal SDE(m) are signals that control an output timing of data voltages from the first SDIC SDIC #1 to the mth SDIC SDIC #(m) to the first active area AA1 to the mth active area AA(m), respectively.

That is, referring to FIG. 2, a data voltage is applied to an nth pixel row for one horizontal period. Thus, the first sub-data enable signal SDE1 to the mth sub-data enable signal SDE(m) may be sequentially output at a turn-on level (e.g., a high level) within one horizontal period.

Specifically, referring to FIG. 4, the first sub-data enable signal SDE1 has a turn-on level during a period from t1 to t3. Thus, the first SDIC SDIC #1 outputs a data voltage to a plurality of pixels PX disposed in an nth row of the first active area AA1 during the period from t1 to t3.

Moreover, a second sub-data enable signal SDE2 has a turn-on level during a period from t3 to t6. Thus, the second SDIC SDIC #2 outputs a data voltage to a plurality of pixels PX disposed in an nth row of the second active area AA2 during a period from t3 to t6.

Furthermore, the m−1th sub-data enable signal SDE(m−1) has a turn-on level during a period from t(3m−6) to t(3m−3). Thus, an m−1th SDIC SDIC #(m−1) outputs a data voltage to a plurality of pixels PX disposed in an nth row of an m−1th active area AA(m−1) during the period from t(3m−6) to t(3m−3).

Furthermore, the mth sub-data enable signal SDE(m) has a turn-on level during a period from t(3m−3) to t(3m). Thus, the mth SDIC SDIC #(m) outputs a data voltage to a plurality of pixels PX disposed in an nth row of the mth active area AA(m) during the period from t(3m−3) to t(3m).

Additionally, as shown in FIG. 4, the first edge data enable signal EDE1 to the mth edge data enable signal EDE(m) are signals that control an output timing of data voltages from the first SDIC SDIC #1 to the mth SDIC SDIC #(m) to the first edge active area EA1 to the mth edge active area EA(m), respectively.

In some embodiments, each edge data enable signal EDE may include a front edge data enable signal FDE and a back edge data enable signal BDE.

However, as described above, the first front edge active area and the mth back edge active area are not present. Therefore, a first front edge data enable signal and an mth back edge data enable signal are not output.

More specifically, a second front edge data enable signal FDE2 to an mth front edge data enable signal FDE(m) are signals that control an output timing of data voltages from the second SDIC SDIC #2 to the mth SDIC SDIC #(m) to a second front edge active area FEA2 to an mth front edge active area FEA(m), respectively. Furthermore, a first back edge data enable signal BDE1 to an m−1th back edge data enable signal BDE(m) are signals that control an output timing of data voltages from the first SDIC SDIC #1 to the m−1th SDIC SDIC #(m−1) to a first back edge active area BEA1 to an mth back edge active area BEA(m−1), respectively.

Specifically, referring to FIG. 4, the first back edge data enable signal BDE1 has a turn-on level during a period from t2 to t3. Thus, the first SDIC SDIC #1 outputs a data voltage to a plurality of pixels PX disposed in an nth row of the first back edge active area BEA1 during the period from t2 to t3.

Additionally, the second front edge data enable signal FDE2 has a turn-on level during a period from t3 to t4. Thus, the second SDIC SDIC #2 outputs a data voltage to a plurality of pixels PX disposed in an nth row of the second front edge active area FEA2 during the period from t3 to t4.

Furthermore, a second back edge data enable signal BDE2 has a turn-on level during a period from t5 to t6. Thus, the second SDIC SDIC #2 outputs a data voltage to a plurality of pixels PX disposed in an nth row of a second back edge active area BEA2 during the period from t5 to t6.

Furthermore, an m−1th front edge data enable signal FDE(m−1) has a turn-on level during a period from t(3m−6) to t(3m−5). Thus, the m−1th SDIC SDIC #(m−1) outputs a data voltage to a plurality of pixels PX disposed in an nth row of an m−1th front edge active area FEA(m−1) during the period from t(3m−6) to t(3m−5).

Moreover, an m−1th back edge data enable signal BDE(m−1) has a turn-on level during a period from t(3m−4) to t(3m−3). Thus, the m−1th SDIC SDIC #(m−1) outputs a data voltage to a plurality of pixels PX disposed in an nth row of an m−1th back edge active area BEA(m−1) during the period from t(3m−4) to t(3m−3).

In addition, the mth front edge data enable signal FDE(m)) has a turn-on level during a period from t(3m−3) to t(3m−2). Thus, the mth SDIC SDIC #(m) outputs a data voltage to a plurality of pixels PX disposed in an nth row of the mth front edge active area FEA(m) during the period from t(3m−3) to t(3m−2).

Referring back to FIG. 3, the data delay unit 142 receives the video data Data and delays the video data Data by one horizontal period and then outputs the delayed video data.

The data delay unit 142 stores the video data Data in an internal memory and delays the video data Data by one horizontal period and then outputs the delayed video data D-Data to each of the plurality of data comparison units 143.

For example, the data delay unit 142 stores the video data Data corresponding to an nth row in an nth horizontal period and outputs the delayed video data D-Data corresponding to the nth row in an n+1th horizontal period.

Further, each of the plurality of data comparison units 143 compares the video data Data and the delayed video data D-Data corresponding to a plurality of active areas AA while a plurality of sub-data enable signals SDE has a turn-on level. Then, each of the plurality of data comparison units 143 generates each of a plurality of comparison data CD. Furthermore, each of the plurality of data comparison units 143 outputs the comparison data CD to the power control signal generators 144. In other words, the comparison data CD may be the maximum data transition value between adjacent pixel rows disposed in each of the plurality of active areas AA.

More specifically, the first data comparison unit 143(1) compares the video data Data and the delayed video data D-Data corresponding to the first active area AA1 while the first sub-data enable signal SDE1 has a turn-on level. Then, the first data comparison unit 143(1) outputs the maximum value of the difference between the video data Data and the delayed video data D-Data as first comparison data CD1.

Additionally, the m−1th data comparison unit 143(*m*−1) compares the video data Data and the delayed video data D-Data corresponding to the m−1th active area AA(m−1) while the m−1th sub-data enable signal SDE(m−1) has a turn-on level. Then, the m−1th data comparison unit 143(*m*−1) outputs the maximum value of the difference between the video data Data and the delayed video data D-Data as m−1th comparison data CD(m−1).

Furthermore, the mth data comparison unit 143(*m*) compares the video data Data and the delayed video data D-Data corresponding to the mth active area AA(m) while the mth sub-data enable signal SDE(m) has a turn-on level. Then, the mth data comparison unit 143(*m*) outputs the maximum value of the difference between the video data Data and the delayed video data D-Data as mth comparison data CD(m).

For example, referring to FIG. 4, the first sub-data enable signal SDE1 has a turn-on level during a period from t1 to t2. Thus, the maximum value of the difference between the video data Data and the delayed video data D-Data corresponding to each of a plurality of pixel columns in the first active area AA1 is output as the first comparison data CD1 during the period from t1 to t2.

Also, the m−1th sub-data enable signal SDE(m−1) has a turn-on level during a period from t(3m−6) to t(3m−3). Thus, the maximum value of the difference between the video data Data and the delayed video data D-Data corresponding to each of a plurality of pixel columns in the m−1th active area AA(m−1) is output as the m−1th comparison data CD(m−1) during the period from t(3m−6) to t(3m−3).

Furthermore, the mth sub-data enable signal SDE(m) has a turn-on level during a period from t(3m−3) to t(3m). Thus, the maximum value of the difference between the video data Data and the delayed video data D-Data corresponding to each of a plurality of pixel columns in the mth active area AA(m) is output as mth comparison data CD(m) during the period from t(3m−3) to t(3m).

Furthermore, the plurality of data comparison units 143 compares the video data Data and the delayed video data D-Data in a plurality of edge active areas EA while a plurality of edge data enable signals EDE has a turn-on level. Then, the plurality of data comparison units 143 generates a plurality of edge comparison data ECD. Furthermore, the plurality of data comparison units 143 outputs the edge comparison data ECD to the power control signal generators 144. In other words, the edge comparison data ECD may be the maximum data transition value between adjacent pixel rows disposed in each of the plurality of edge active areas EA.

More specifically, the first data comparison unit 143(1) compares the video data Data and the delayed video data D-Data corresponding to the first edge active area EA1 while the first edge data enable signal EDE1 has a turn-on level. Then, the first data comparison unit 143(1) outputs the maximum value of the difference between the video data Data and the delayed video data D-Data as first edge comparison data ECD1.

Also, the m−1th data comparison unit 143(*m*−1) compares the video data Data and the delayed video data D-Data corresponding to an m−1th edge active area EA(m−1) while the m−1th edge data enable signal EDE(m−1) has a turn-on level. Then, the m−1th data comparison unit 143(*m*−1) outputs the maximum value of the difference between the video data Data and the delayed video data D-Data as m−1th edge comparison data ECD(m−1).

Furthermore, the mth data comparison unit 143(*m*) compares the video data Data and the delayed video data D-Data corresponding to the mth edge active area EA(m) while the mth edge data enable signal EDE(m) has a turn-on level. Then, the mth data comparison unit 143(*m*) outputs the maximum value of the difference between the video data Data and the delayed video data D-Data as an mth edge comparison data ECD(m).

For example, referring to FIG. 4, the first back edge data enable signal BDE1 has a turn-on level during a period from t2 to t3. Thus, the video data Data and the delayed video data D-Data corresponding to the first back edge active area BEA1 are compared with each other. Then, the maximum value of the difference between the video data Data and the delayed video data D-Data is output as the first edge comparison data ECD1.

Also, the m−1th front edge data enable signal FDE(m−1) has a turn-on level during a period from t(3m−6) to t(3m−5). Thus, the video data Data and the delayed video data D-Data corresponding to the m−1th front edge active area FEA(m−1) are compared with each other. Then, the maximum value of the difference between the video data Data and the delayed video data D-Data is output as the m−1th edge comparison data ECD(m−1).

Further, the m−1th back edge data enable signal BDE(m−1) has a turn-on level during a period from t(3m−4) to t(3m−3). Thus, the video data Data and the delayed video data D-Data corresponding to the m−1th back edge active area BEA(m−1) are compared with each other. Then, the maximum value of the difference between the video data Data and the delayed video data D-Data is output as the m−1th edge comparison data ECD(m−1).

Moreover, the mth front edge data enable signal FDE(m) has a turn-on level during a period from t(3m−3) to t(3m−2). Thus, the video data Data and the delayed video data D-Data corresponding to the mth front edge active area FEA(m) are compared with each other. Then, the maximum value of the difference between the video data Data and the delayed video data D-Data is output as the mth edge comparison data ECD(m).

In some embodiments, each of the plurality of data comparison units 143 outputs the generated comparison data CD and edge comparison data ECD to the power control signal generator 144 corresponding to an active area and the power control signal generator 144 corresponding to one or more adjacent active areas.

Specifically, the first data comparison unit 143(1) outputs the first comparison data CD1 and the first edge comparison data ECD1 to a first power control signal generator 144(1) corresponding to a first active area AA1. In addition, the first data comparison unit 143(1) outputs the first comparison data CD1 and the first edge comparison data ECD1 to a second power control signal generator corresponding to a second active area AA2 adjacent to the first active area AA1.

Furthermore, the m−1th data comparison unit 143(*m*−1) outputs the m−1th comparison data CD(m−1) and the m−1th edge comparison data ECD(m−1) to an m−1th power control signal generator 144(*m*−1) corresponding to an m−1th active area AA(m−1). In addition, the m−1th data comparison unit 143(*m*−1) outputs the m−1th comparison data CD(m−1) and the m−1th edge comparison data ECD(m−1) to an m−2th power control signal generator 144(m−2) corresponding to an m−2th active area AA(m−2) adjacent to the m−1th active area AA(m−1). Furthermore, the m−1th data comparison unit 143(m−1) outputs the m−1th comparison data CD(m−1) and the m−1th edge comparison data ECD(m−1) to an mth power control signal generator 144(*m*) corresponding to an mth active area AA(m) adjacent to the m−1th active area AA(m−1).

Furthermore, the mth data comparison unit 143(*m*) outputs the mth comparison data CD(m) and the mth edge comparison data ECD(m) to the mth power control signal generator 144(*m*) corresponding to the mth active area AA(m). In addition, the mth data comparison unit 143(*m*) outputs the mth comparison data CD(m) and the mth edge comparison data ECD(m) to the m−1th power control signal generator 144(*m*−1) corresponding to an m−1th active area AA(m−1) adjacent to the mth active area AA(m).

FIG. 5 illustrates a look-up table (LUT) of a power control signal generator of the display device according to an embodiment of the present disclosure.

The power control signal generators 144 generate power control signals PWRC using the comparison data CD and the edge comparison data ECD.

Specifically, each of the power control signal generators 144 sets a first reference value SV1 for each of the received plurality of comparison data CD by applying each of the received plurality of comparison data CD to a first look-up table $1^{st}$ LUT.

Moreover, each of the power control signal generators 144 sets a second reference value SV2 for each of the received plurality of edge comparison data ECD by applying each of the received plurality of edge comparison data ECD to a second look-up table $2^{nd}$ LUT.

Furthermore, the power control signal generators 144 set a compensation value CV by calculating a difference value DV between a first reference value SV1 of an active area and a second reference value SV2 of an adjacent edge active area and applying the difference value DV to a third look-up table $3^{rd}$ LUT.

Furthermore, the power control signal generators 144 add the compensation value CV to the first reference value SV1 of the active area and output a result as a power control signal PWRC.

Referring to FIG. 3 and FIG. 5, each power control signal generator 144 (such as the first power control signal generator 144(1), the m−1th power control signal generator 144(*m*−1) and the mth power control signal generator 144(*m*)) sets the first reference value SV1 by comparing the comparison data CD with a plurality of thresholds stored in the first look-up table $1^{st}$ LUT. For example, if the comparison data CD is equal to or smaller than a first threshold Th 1, the first reference value SV1 is set to 0 (LLL). If the comparison data CD is greater than the first threshold Th 1 and equal to or smaller than a second threshold Th 2, the first reference value SV1 is set to 1 (LLH). If the comparison data CD is greater than the second threshold Th 2 and equal to or smaller than a third threshold Th 3, the first reference value SV1 is set to 1 (LLH). If the comparison data CD is greater than the third threshold Th 3 and equal to or smaller than a fourth threshold Th 4, the first reference value SV1 is set to 2 (LHL). If the comparison data CD is greater than the fourth threshold Th 4 and equal to or smaller than a fifth threshold Th 5, the first reference value SV1 is set to 2 (LHL). If the comparison data CD is greater than the fifth threshold Th 5 and equal to or smaller than a sixth threshold Th 6, the first reference value SV1 is set to 3 (LHH). If the comparison data CD is greater than the sixth threshold Th 6 and equal to or smaller than a seventh threshold Th 7, the first reference value SV1 is set to 4 (HLL). If the comparison data CD is greater than the seventh threshold Th 7 and equal to or smaller than an eighth threshold Th 8, the first reference value SV1 is set to 4 (HLL). If the comparison data CD is greater than the eighth threshold Th 8, the first reference value SV1 is set to 4 (HLL). The above-described first threshold Th 1 to eighth threshold Th 8 are values stored in a memory of each of the power control signal generator 144 (e.g., the first power control signal generator 144(1), the m−1th power control signal generator 144(*m*−1) and the mth power control signal generator 144(*m*)). The above-described first threshold Th 1 to eighth threshold Th 8 may vary depending on settings.

Additionally, each power control signal generator 144 (such as the first power control signal generator 144(1), the m−1th power control signal generator 144(*m*−1) and the mth power control signal generator 144(*m*)) sets the second reference value SV2 by comparing the edge comparison data ECD with a plurality of thresholds stored in the second look-up table 2nd LUT. For example, if the edge comparison data ECD is equal to or smaller than the first threshold Th 1, the second reference value SV2 is set to 0 (LLL). If the edge comparison data ECD is greater than the first threshold Th 1 and equal to or smaller than the second threshold Th 2, the second reference value SV2 is set to 1 (LLH). If the edge comparison data ECD is greater than the second threshold Th 2 and equal to or smaller than the third threshold Th 3, the second reference value SV2 is set to 1 (LLH). If the edge comparison data ECD is greater than the third threshold Th 3 and equal to or smaller than the fourth threshold Th 4, the second reference value SV2 is set to 2 (LHL). If the edge comparison data ECD is greater than the fourth threshold Th 4 and equal to or smaller than the fifth threshold Th 5, the second reference value SV2 is set to 2 (LHL). If the edge comparison data ECD is greater than the fifth threshold Th 5 and equal to or smaller than the sixth threshold Th 6, the second reference value SV2 is set to 3 (LHH). If the edge comparison data ECD is greater than the sixth threshold Th 6 and equal to or smaller than the seventh threshold Th 7, the second reference value SV2 is set to 4 (HLL). If the edge comparison data ECD is greater than the seventh threshold Th 7 and equal to or smaller than the eighth threshold Th 8, the second reference value SV2 is set to 4 (HLL). If the edge comparison data ECD is greater than the eighth threshold Th 8, the second reference value SV2 is set to 4 (HLL). The above-described first threshold Th 1 to eighth threshold Th 8 are values stored in the memory of each of the first power control signal generator 144(1), the m−1th power control signal generator 144(*m*−1) and the mth power control signal generator 144(*m*). The above-described first threshold Th 1 to eighth threshold Th 8 may vary depending on settings.

Then, each power control signal generator 144 (e.g., the first power control signal generator 144(1), the m−1th power control signal generator 144(*m*−1) and the mth power control signal generator 144(*m*)) calculates the difference value DV between the first reference value SV1 corresponding to an active area and the second reference value SV2 corresponding to an adjacent edge active area. Then, each power control signal generator (e.g., the first power control signal generator 144(1), the m−1th power control signal generator 144(*m*−1) and the mth power control signal generator 144(*m*)) sets a compensation value CV by applying the difference value DV to the third look-up table $3^{rd}$ LUT.

More specifically, if the difference value DV between the first reference value SV1 corresponding to the active area and the second reference value SV2 corresponding to the adjacent edge active area is 0 (LLL), the compensation value CV is set to 0 (LLL). If the difference value DV between the first reference value SV1 corresponding to the active area and the second reference value SV2 corresponding to the adjacent edge active area is 1 (LLH), the compensation value CV is set to 0 (LLL). If the difference value DV between the first reference value SV1 corresponding to the active area and the second reference value SV2 corresponding to the adjacent edge active area is 2 (LHL), the compensation value CV is set to 1 (LLH). If the difference value DV between the first reference value SV1 corresponding to the active area and the second reference value SV2 corresponding to the adjacent edge active area is 3 (LHH), the compensation value CV is set to 1 (LLH). If the difference value DV between the first reference value SV1 corresponding to the active area and the second reference value SV2 corresponding to the adjacent edge active area is 3 (LHH), the compensation value CV is set to 1 (LLH). If the difference value DV between the first reference value SV1 corresponding to the active area and the second reference value SV2 corresponding to the adjacent edge active area is 4 (HLL), the compensation value CV is set to 2 (LHL).

Furthermore, each power control signal generator 144 (e.g., the first power control signal generator 144(1), the m−1th power control signal generator 144(*m*−1) and the mth power control signal generator 144(*m*)) adds the compensation value CV to the first reference value SV1 and outputs a result as the power control signal PWRC.

For example, the first power control signal generator 144(1) sets the compensation value CV depending on the difference value DV between the first reference value SV1 corresponding to the first active area and the second reference value SV2 corresponding to the second front edge active area. Then, the first power control signal generator 144(1) adds the compensation value CV to the first reference value SV1 corresponding to the first active area and outputs a result as a first power control signal PWRC1.

The m−1th power control signal generator 144(*m*−1) sets the compensation value CV depending on the difference value DV between the first reference value SV1 corresponding to the m−1th active area and the second reference value SV2 corresponding to the mth front edge active area. Then, the m−1th power control signal generator 144(*m*−1) adds the compensation value CV to the first reference value SV1 corresponding to the m−1th active area and outputs a result as an m−1th power control signal PWRC(m−1).

The mth power control signal generator 144(*m*) sets the compensation value CV depending on the difference value DV between the first reference value SV1 corresponding to the mth active area and the second reference value SV2 corresponding to the m−1th back edge active area. Then, the mth power control signal generator 144(*m*) adds the compensation value CV to the first reference value SV1 corresponding to the mth active area and outputs a result as an mth power control signal PWRC(m).

For example, when the first reference value SV1 corresponding to the mth active area is substituted by 0 (LLL) and the second reference value SV2 corresponding to the m−1th back edge active area is substituted by 4 (HLL), the difference value DV is 4 (HLL). Thus, the compensation value CV may be 2 (LHL). Accordingly, the mth power control signal generator 144(*m*) may add 2 (LHL), which is the compensation value CV, to (LLL), which is the first reference value SV1 corresponding to the mth active area, and output 2 (LHL) as the mth power control signal PWRC(m).

Figure 6:
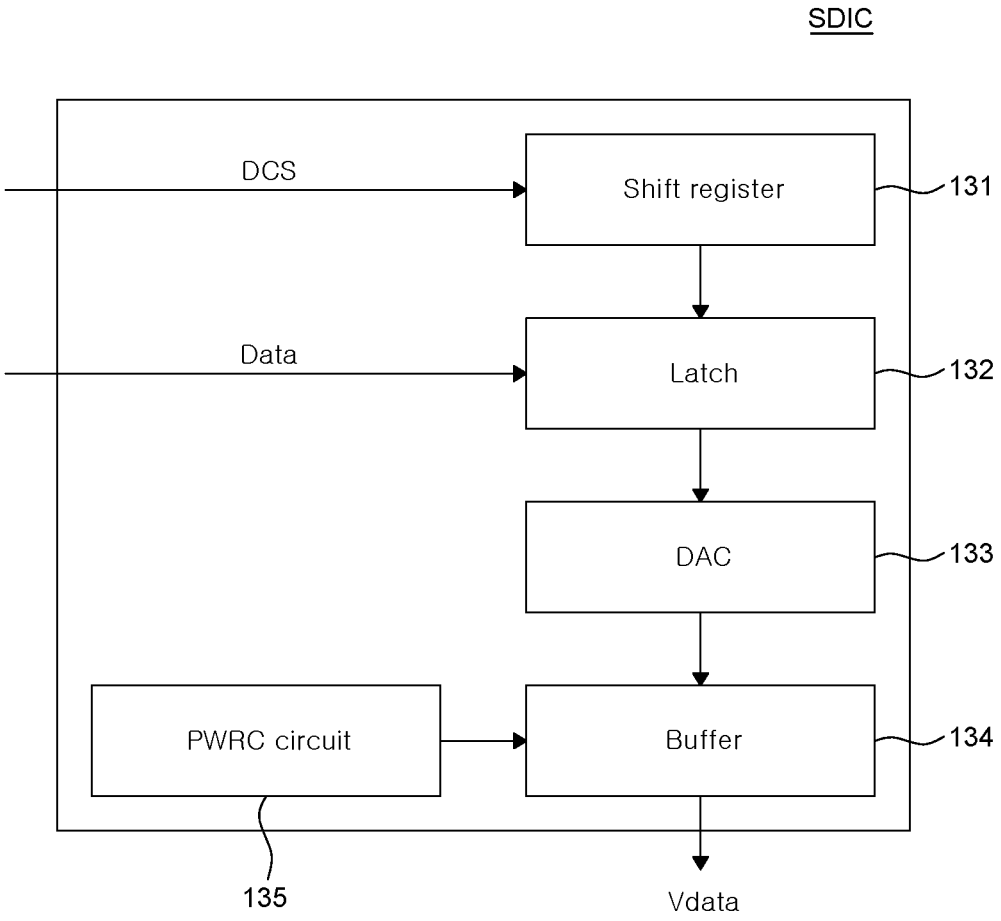
FIG. 6 is a diagram provided to explain a source driving integrated circuit (SDIC) of the display device according to an embodiment of the present disclosure.

FIG. 6 is a diagram provided to explain a source driving integrated circuit (SDIC) of the display device according to an embodiment of the present disclosure.

Each of a plurality of SDICs SDIC includes a shift register 131, a latch unit 132, a digital-analog converter (DAC) 133, a buffer 134, and a power control circuit 135.

The shift register 131 receives data control signals DCS including a source start pulse and a source sampling clock from the timing controller 140 and determines sequential data sampling timings.

The latch unit 132 sequentially latches red, green and blue digital video data Data transmitted from the timing controller 140 in response to a sampling signal transmitted from the shift register 131 and simultaneously outputs the latched data.

The DAC 133 converts the red, green and blue digital video data Data from the latch unit 132 into an analog data voltage Vdata by using an analog gamma voltage.

The buffer 134 may output the analog data voltage Vdata transmitted from the DAC 133 to a data line.

The power control circuit (PWRC circuit) 135 is switched in response to a power control signal PWRC transmitted from the timing controller 140 and controls the amount of current to be applied to the buffer 134. Thus, the PWRC circuit 135 may control power consumption of the data driver.

Figure 7:
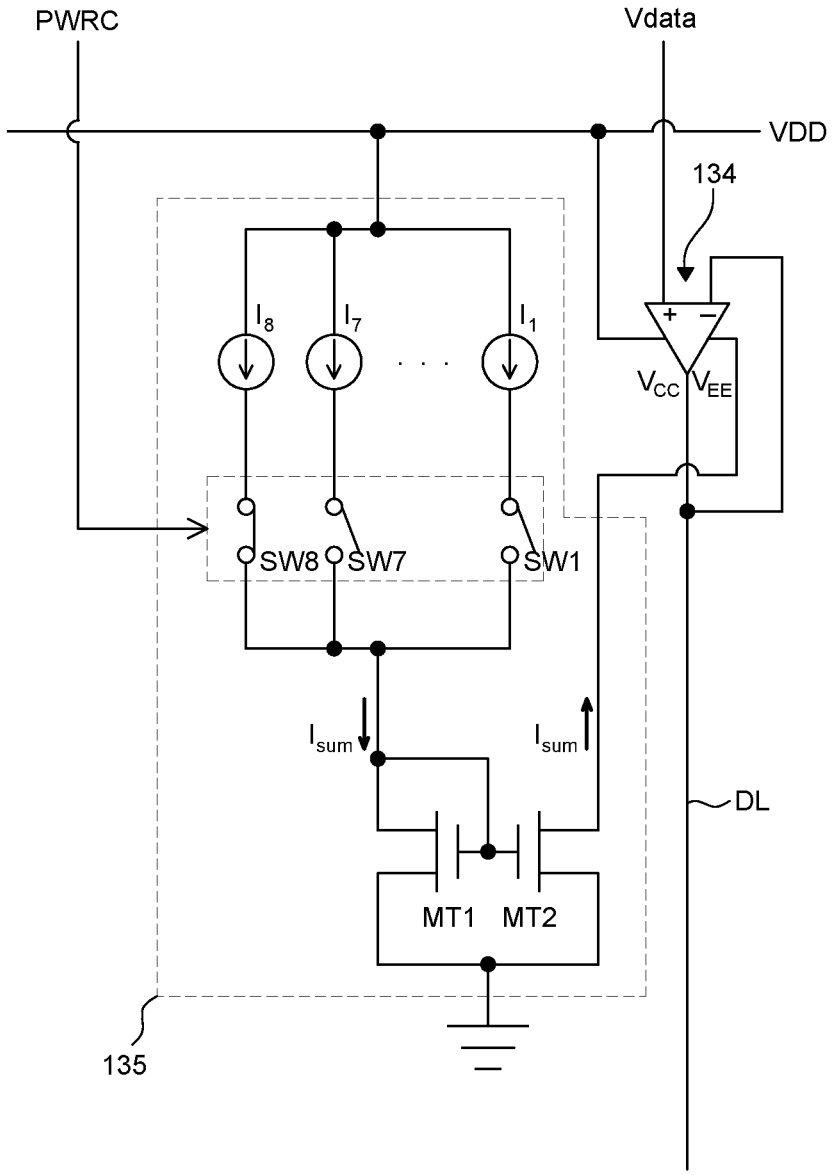
FIG. 7 is a circuit diagram provided to explain a power control circuit and a buffer of the display device according to an embodiment of the present disclosure.

FIG. 7 is a circuit diagram illustrating a power control circuit and a buffer of the display device according to an embodiment of the present disclosure.

Referring to FIG. 7, the buffer 134 may be configured by at least one operating amplifier and disposed corresponding to each of the plurality of data lines DL.

The buffer 134 may amplify and output the analog data voltage Vdata received through a non-inverting input terminal +. Further, an inverting input terminal − of the buffer 134 is connected to a data line DL connected to an output terminal. A terminal $V_{CC}$ of the buffer 134 is connected to a driving power supply VDD, and a terminal $V_{EE}$ is connected to the power control circuit 135.

The power control circuit 135 determines the intensity of a driving current $I_{SUM}$ to be applied to the buffer 134.

The PWRC circuit 135 includes a plurality of current sources $I_1, \ldots, I_7, I_8$, a plurality of switches SW1, . . . , SW7, SW8 and a current mirror circuit having a first mirror transistor MT1 and a second mirror transistor MT2.

Each of the plurality of switches SW1, . . . , SW7, SW8 is connected in series to a corresponding current source of the plurality of current sources $I_1, \ldots, I_7, I_8$. Furthermore, each of the switches SW1, . . . , SW7, SW8 connected in series to a corresponding current source, are connected in parallel each other. Therefore, the intensity of the driving current $I_{SUM}$ to be output to the current mirror circuit is determined depending on an on-state of the plurality of switches SW1, . . . , SW7, SW8.

The first mirror transistor MT1 and the second mirror transistor MT2 constitute a current mirror circuit.

A gate electrode and a source electrode of the first mirror transistor MT1 are connected to a plurality of switches and applied with the driving current $I_{SUM}$.

Further, a gate electrode of the second mirror transistor MT2 is connected to the gate electrode of the first mirror transistor MT1. A drain electrode of the second mirror transistor MT2 is connected to the terminal $V_{EE}$ of the buffer 134.

Thus, a source-drain current of the second mirror transistor MT2 is determined as the driving current $I_{SUM}$. Further, the driving current $I_{SUM}$ output by the second mirror transistor MT2 is output to the terminal $V_{EE}$ of the buffer 134.

Accordingly, the power control circuit 135 controls an amplification ratio of the buffer 134 to control power consumption of the buffer 134.

As described above, the display device according to an embodiment of the present disclosure generates a power control signal depending on a difference value between comparison data which is the maximum data transition value between adjacent pixel rows disposed in each of a plurality of active areas and edge comparison data which is the maximum data transition value between adjacent pixel rows disposed in a plurality of edge active areas. Thus, it is possible to control the intensity of a driving current of a plurality of SDICs.

The level of data transition in an edge active area is applied to the intensity of a driving current. Thus, when data voltages for representing the same gray scale are applied to a plurality of active areas, it is possible to suppress a defect, such as a block dim, at a boundary.

Also, the display device according to an embodiment of the present disclosure can adjust the intensity of a driving current of a plurality of SDICs by using comparison data which is the maximum data transition value between adjacent pixel rows disposed in each of a plurality of active areas. Thus, it is possible to set an optimal driving current intensity for each active area.

Therefore, it is possible to determine an optimal driving power for each active area and thus optimize power consumption of the display device according to an embodiment of the present disclosure.

Hereinafter, a driving method of a display device according to an embodiment of the present disclosure will be described. The driving method of a display device according to an embodiment of the present disclosure will be described with reference to the above-described display device according to an embodiment of the present disclosure.

Figure 8:
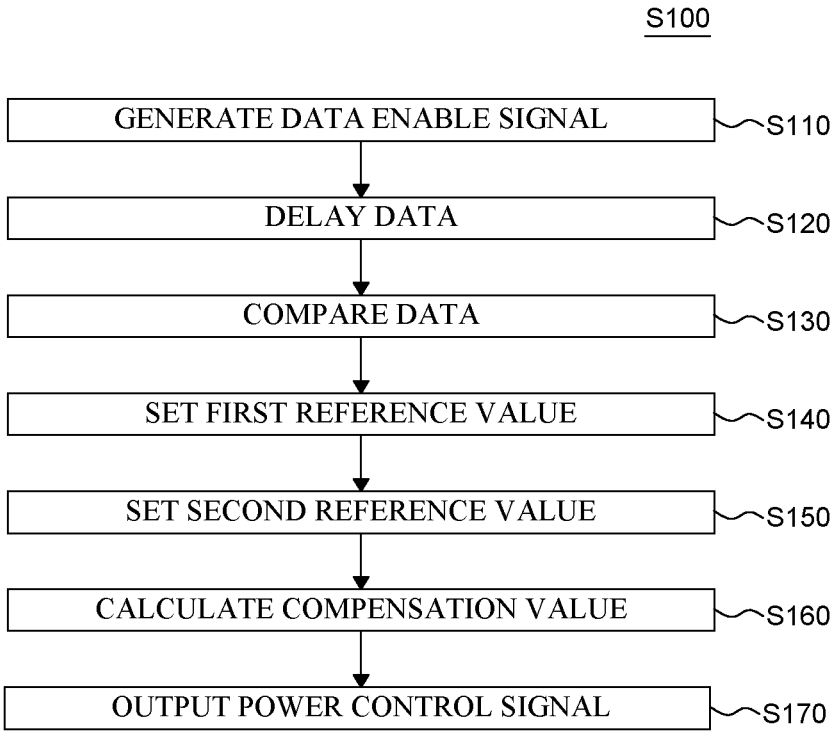
FIG. 8 is a flowchart provided to explain a driving method of a display device according to an embodiment of the present disclosure.

FIG. 8 is a flowchart provided to explain a driving method of a display device according to an embodiment of the present disclosure.

As shown in FIG. 8, a driving method S100 of a display device according to an embodiment of the present disclosure includes a data enable signal generation process S110, a data delay process S120, and a data comparison process S130. Further, the driving method S100 includes a first reference value setting process S140, a second reference value setting process S150, a compensation value calculation process S160, and a power control signal output process S170.

In the data enable signal generation process S110, a sub-data enable signal SDE and an edge data enable signal EDE are generated in synchronization with the DE and the DCLK.

As shown in FIG. 4, the first sub-data enable signal SDE1 to the mth sub-data enable signal SDE(m) are signals that control an output timing of data voltages from the first SDIC SDIC #1 to the mth SDIC SDIC #(m) to the first active area AA1 to the mth active area AA(m), respectively.

That is, referring to FIG. 2, a data voltage is applied to an nth pixel row for one horizontal period. Thus, the first sub-data enable signal SDE1 to the mth sub-data enable signal SDE(m) may be sequentially output at a high level, which is a turn-on level, within one horizontal period.

Specifically, referring to FIG. 4, the first sub-data enable signal SDE1 has a turn-on level during a period from t1 to t3. Thus, the first SDIC SDIC #1 outputs a data voltage to a plurality of pixels PX disposed in an nth row of the first active area AA1 during the period from t1 to t3.

Also, a second sub-data enable signal SDE2 has a turn-on level during a period from t3 to t6. Thus, the second SDIC SDIC #2 outputs a data voltage to a plurality of pixels PX disposed in an nth row of the second active area AA2 during the period from t3 to t6.

Further, the m−1th sub-data enable signal SDE(m−1) has a turn-on level during a period from t(3m−6) to t(3m−3). Thus, an m−1th SDIC SDIC #(m−1) outputs a data voltage to a plurality of pixels PX disposed in an nth row of an m−1th active area AA(m−1) during the period from t(3m−6) to t(3m−3).

Furthermore, the mth sub-data enable signal SDE(m) has a turn-on level during a period from t(3m−3) to t(3m). Thus, the mth SDIC SDIC #(m) outputs a data voltage to a plurality of pixels PX disposed in an nth row of the mth active area AA(m) during the period from t(3m−3) to t(3m).

Also, as shown in FIG. 4, the first edge data enable signal EDE1 to the mth edge data enable signal EDE(m) are signals that control an output timing of data voltages from the first SDIC SDIC #1 to the mth SDIC SDIC #(m) to the first edge active area EA1 to the mth edge active area EA(m), respectively.

A plurality of edge data enable signals EDE may include a plurality of front edge data enable signals FDA and a plurality of back edge data enable signals BDE.

However, as described above, the first front edge active area and the mth back edge active area are not present. Therefore, a first front edge data enable signal and an mth back edge data enable signal are not output.

More specifically, a second front edge data enable signal FDE2 to an mth front edge data enable signal FDE(m) are signals that control an output timing of data voltages from the second SDIC SDIC #2 to the mth SDIC SDIC #(m) to a second front edge active area FEA2 to an mth front edge active area FEA(m), respectively. Further, a first back edge data enable signal BDE1 to an m−1th back edge data enable signal BDE(m) are signals that control an output timing of data voltages from the first SDIC SDIC #1 to the m−1th SDIC SDIC #(m−1) to a first back edge active area BEA1 to an mth back edge active area BEA(m−1), respectively.

Specifically, referring to FIG. 4, the first back edge data enable signal BDE1 has a turn-on level during a period from t2 to t3. Thus, the first SDIC SDIC #1 outputs a data voltage to a plurality of pixels PX disposed in an nth row of the first back edge active area BEA1 during the period from t2 to t3.

Also, the second front edge data enable signal FDE2 has a turn-on level during a period from t3 to t4. Thus, the second SDIC SDIC #2 outputs a data voltage to a plurality of pixels PX disposed in an nth row of the second front edge active area FEA2 during the period from t3 to t4.

Further, a second back edge data enable signal BDE2 has a turn-on level during a period from t5 to t6. Thus, the second SDIC SDIC #2 outputs a data voltage to a plurality of pixels PX disposed in an nth row of a second back edge active area BEA2 during the period from t5 to t6.

Furthermore, an m−1th front edge data enable signal FDE(m−1) has a turn-on level during a period from t(3m−6) to t(3m−5). Thus, the m−1th SDIC SDIC #(m−1) outputs a data voltage to a plurality of pixels PX disposed in an nth row of an m−1th front edge active area FEA(m−1) during the period from t(3m−6) to t(3m−5).

Moreover, an m−1th back edge data enable signal BDE (m−1) has a turn-on level during a period from t(3m−4) to t(3m−3). Thus, the m−1th SDIC SDIC #(m−1) outputs a data voltage to a plurality of pixels PX disposed in an nth row of an m−1th back edge active area BEA(m−1) during the period from t(3m−4) to t(3m−3).

Also, the mth front edge data enable signal FDE(m) has a turn-on level during a period from t(3m−3) to t(3m−2). Thus, the mth SDIC SDIC #(m) outputs a data voltage to a plurality of pixels PX disposed in an nth row of the mth front edge active area FEA(m) during the period from t(3m−3) to t(3m−2).

In the data delay process S120, the video data Data is received, delayed by one horizontal period, and then output.

In the data delay process S120, the video data Data is stored in an internal memory and delayed by one horizontal period, and then the delayed video data D-Data is output.

For example, the video data Data corresponding to an nth row is stored in an nth horizontal period and the delayed video data D-Data corresponding to the nth row is output in an n+1th horizontal period.

Further, in the data comparison process S130, the video data Data and the delayed video data D-Data corresponding to a plurality of active areas AA are compared while a plurality of sub-data enable signals SDE has a turn-on level. Then, each of a plurality of comparison data CD is generated. In other words, the comparison data CD may be the maximum data transition value between adjacent pixel rows disposed in each of the plurality of active areas AA.

More specifically, in the data comparison process S130, the video data Data and the delayed video data D-Data corresponding to the first active area AA1 are compared while the first sub-data enable signal SDE1 has a turn-on level. Then, the maximum value of the difference between the video data Data and the delayed video data D-Data is output as first comparison data CD1.

Also, in the data comparison process S130, the video data Data and the delayed video data D-Data corresponding to the m−1th active area AA(m−1) are compared since the m−1th sub-data enable signal SDE(m−1) has a turn-on level. Then, the maximum value of the difference between the video data Data and the delayed video data D-Data is output as m−1th comparison data CD(m−1).

Further, in the data comparison process S130, the video data Data and the delayed video data D-Data corresponding to the mth active area AA(m) are compared since the mth sub-data enable signal SDE(m) has a turn-on level. Then, the maximum value of the difference between the video data Data and the delayed video data D-Data is output as mth comparison data CD(m).

For example, referring to FIG. 4, the first sub-data enable signal SDE1 has a turn-on level during a period from t1 to t2. Thus, the maximum value of the difference between the video data Data and the delayed video data D-Data corresponding to each of a plurality of pixel columns in the first active area AA1 is output as the first comparison data CD1 during the period from t1 to t2.

additionally, the m−1th sub-data enable signal SDE(m−1) has a turn-on level during a period from t(3m−6) to t(3m−3). Thus, the maximum value of the difference between the video data Data and the delayed video data D-Data corresponding to each of a plurality of pixel columns in the m−1th active area AA(m−1) is output as the m−1th comparison data CD(m−1) during the period from t(3m−6) to t(3m−3).

Furthermore, the mth sub-data enable signal SDE(m) has a turn-on level during a period from t(3m−3) to t(3m). Thus, the maximum value of the difference between the video data Data and the delayed video data D-Data corresponding to each of a plurality of pixel columns in the mth active area AA(m) is output as mth comparison data CD(m) during the period from t(3m−3) to t(3m).

Furthermore, in the data comparison process S130, the video data Data and the delayed video data D-Data are compared in a plurality of edge active areas EA while a plurality of edge data enable signals EDE has a turn-on level. Then, a plurality of edge comparison data ECD is generated. In other words, the edge comparison data ECD may be the maximum data transition value between adjacent pixel rows disposed in each of the plurality of edge active areas EA.

More specifically, in the data comparison process S130, the video data Data and the delayed video data D-Data corresponding to the first edge active area EA1 are compared while the first edge data enable signal EDE1 has a turn-on level. Then, the maximum value of the difference between the video data Data and the delayed video data D-Data is output as first edge comparison data ECD1.

additionally, in the data comparison process S130, the video data Data and the delayed video data D-Data corresponding to an m−1th edge active area EA(m−1) are compared while the m−1th edge data enable signal EDE(m−1) has a turn-on level. Then, the maximum value of the difference between the video data Data and the delayed video data D-Data is output as m−1th edge comparison data ECD(m−1).

Furthermore, in the data comparison process S130, the video data Data and the delayed video data D-Data corresponding to the mth edge active area EA(m) are compared while the mth edge data enable signal EDE(m) has a turn-on level. Then, the maximum value of the difference between the video data Data and the delayed video data D-Data is output as mth edge comparison data ECD(m).

For example, referring to FIG. 4, the first back edge data enable signal BDE1 has a turn-on level during a period from t2 to t3. Thus, the video data Data and the delayed video data D-Data corresponding to the first back edge active area BEA1 are compared with each other. Then, the maximum value of the difference between the video data Data and the delayed video data D-Data is output as the first edge comparison data ECD1.

Additionally, the m−1th front edge data enable signal FDE(m−1) has a turn-on level during a period from t(3m−6) to t(3m−5). Thus, the video data Data and the delayed video data D-Data corresponding to the m−1th front edge active area FEA(m−1) are compared with each other. Then, the maximum value of the difference between the video data Data and the delayed video data D-Data is output as the m−1th edge comparison data ECD(m−1).

Furthermore, the m−1th back edge data enable signal BDE(m−1) has a turn-on level during a period from t(3m−4) to t(3m−3). Thus, the video data Data and the delayed video data D-Data corresponding to the m−1th back edge active area BEA(m−1) are compared with each other. Then, the maximum value of the difference between the video data Data and the delayed video data D-Data is output as the m−1th edge comparison data ECD(m−1).

Moreover, the mth front edge data enable signal FDE(m) has a turn-on level during a period from t(3m−3) to t(3m−2). Thus, the video data Data and the delayed video data D-Data corresponding to the mth front edge active area FEA(m) are compared with each other. Then, the maximum value of the difference between the video data Data and the delayed video data D-Data is output as the mth edge comparison data ECD(m).

In the first reference value setting process S140, the first reference value SV1 is set by comparing the comparison data CD with a plurality of thresholds stored in the first look-up table 1st LUT. For example, if the comparison data CD is equal to or smaller than a first threshold Th 1, the first reference value SV1 is set to 0 (LLL). If the comparison data CD is greater than the first threshold Th 1 and equal to or smaller than a second threshold Th 2, the first reference value SV1 is set to 1 (LLH). If the comparison data CD is greater than the second threshold Th 2 and equal to or smaller than a third threshold Th 3, the first reference value SV1 is set to 1 (LLH). If the comparison data CD is greater than the third threshold Th 3 and equal to or smaller than a fourth threshold Th 4, the first reference value SV1 is set to 2 (LHL). If the comparison data CD is greater than the fourth threshold Th 4 and equal to or smaller than a fifth threshold Th 5, the first reference value SV1 is set to 2 (LHL). If the comparison data CD is greater than the fifth threshold Th 5 and equal to or smaller than a sixth threshold Th 6, the first reference value SV1 is set to 3 (LHH). If the comparison data CD is greater than the sixth threshold Th 6 and equal to or smaller than a seventh threshold Th 7, the first reference value SV1 is set to 4 (HLL). If the comparison data CD is greater than the seventh threshold Th 7 and equal to or smaller than an eighth threshold Th 8, the first reference value SV1 is set to 4 (HLL). If the comparison data CD is greater than the eighth threshold Th 8, the first reference value SV1 is set to 4 (HLL). The above-described first threshold Th 1 to eighth threshold Th 8 are values stored in a memory of each power control signal generator 144 (e.g., the first power control signal generator 144(1), the m−1th power control signal generator 144(*m*−1) and the mth power control signal generator 144(*m*)). The above-described first threshold Th 1 to eighth threshold Th 8 may vary depending on settings.

Furthermore, in the second reference value setting process S150, the second reference value SV2 is set by comparing the edge comparison data ECD with a plurality of thresholds stored in the second look-up table 2nd LUT. For example, if the edge comparison data ECD is equal to or smaller than the first threshold Th 1, the second reference value SV2 is set to 0 (LLL). If the edge comparison data ECD is greater than the first threshold Th 1 and equal to or smaller than the second threshold Th 2, the second reference value SV2 is set to 1 (LLH). If the edge comparison data ECD is greater than the second threshold Th 2 and equal to or smaller than the third threshold Th 3, the second reference value SV2 is set to 1 (LLH). If the edge comparison data ECD is greater than the third threshold Th 3 and equal to or smaller than the fourth threshold Th 4, the second reference value SV2 is set to 2 (LHL). If the edge comparison data ECD is greater than the fourth threshold Th 4 and equal to or smaller than the fifth threshold Th 5, the second reference value SV2 is set to 2 (LHL). If the edge comparison data ECD is greater than the fifth threshold Th 5 and equal to or smaller than the sixth threshold Th 6, the second reference value SV2 is set to 3 (LHH). If the edge comparison data ECD is greater than the sixth threshold Th 6 and equal to or smaller than the seventh threshold Th 7, the second reference value SV2 is set to 4 (HLL). If the edge comparison data ECD is greater than the seventh threshold Th 7 and equal to or smaller than the eighth threshold Th 8, the second reference value SV2 is set to 4 (HLL). If the edge comparison data ECD is greater than the eighth threshold Th 8, the second reference value SV2 is set to 4 (HLL). The above-described first threshold Th 1 to eighth threshold Th 8 are values stored in the memory of each power control signal generator 144 (e.g., the first power control signal generator 144(1), the m−1th power control signal generator 144(*m*−1) and the mth power control signal generator 144(*m*)). The above-described first threshold Th 1 to eighth threshold Th 8 may vary depending on settings.

Then, in the compensation value calculation process S160, the difference value DV between the first reference value SV1 corresponding to an active area and the second reference value SV2 corresponding to an adjacent edge active area is calculated. Then, a compensation value CV is set by applying the difference value DV to the third look-up table 3rd LUT.

More specifically, in the compensation value calculation process S160, if the difference value DV between the first reference value SV1 corresponding to the active area and the second reference value SV2 corresponding to the adjacent edge active area is 0 (LLL), the compensation value CV is set to 0 (LLL). If the difference value DV between the first reference value SV1 corresponding to the active area and the second reference value SV2 corresponding to the adjacent edge active area is 1 (LLH), the compensation value CV is set to 0 (LLL). If the difference value DV between the first reference value SV1 corresponding to the active area and the second reference value SV2 corresponding to the adjacent edge active area is 2 (LHL), the compensation value CV is set to 1 (LLH). If the difference value DV between the first reference value SV1 corresponding to the active area and the second reference value SV2 corresponding to the adjacent edge active area is 3 (LHH), the compensation value CV is set to 1 (LLH). If the difference value DV between the first reference value SV1 corresponding to the active area and the second reference value SV2 corresponding to the adjacent edge active area is 3 (LHH), the compensation value CV is set to 1 (LLH). If the difference value DV between the first reference value SV1 corresponding to the active area and the second reference value SV2 corresponding to the adjacent edge active area is 4 (HLL), the compensation value CV is set to 2 (LHL).

Further, in the power control signal output process S170, the compensation value CV is added to the first reference value SV1, and a result is output as the power control signal PWRC.

For example, in the power control signal output process S170, the compensation value CV is set depending on the difference value DV between the first reference value SV1 corresponding to the first active area and the second reference value SV2 corresponding to the second front edge active area. Then, the compensation value CV is added to the first reference value SV1 corresponding to the first active area, and a result is output as a first power control signal PWRC1.

In the power control signal output process S170, the compensation value CV is set depending on the difference value DV between the first reference value SV1 corresponding to the m−1th active area and the second reference value SV2 corresponding to the mth front edge active area. Then, the compensation value CV is added to the first reference value SV1 corresponding to the m−1th active area, and a result is output as an m−1th power control signal PWRC (m−1).

In the power control signal output process S170, the compensation value CV is set depending on the difference value DV between the first reference value SV1 corresponding to the mth active area and the second reference value SV2 corresponding to the m−1th back edge active area. Then, the compensation value CV is added to the first reference value SV1 corresponding to the mth active area and a result is output as an mth power control signal PWRC(m).

Specifically, when the first reference value SV1 corresponding to the mth active area is substituted by 0 (LLL) and the second reference value SV2 corresponding to the m−1th back edge active area is substituted by 4 (HLL), the difference value DV is 4 (HLL). Thus, the compensation value CV may be 2 (LHL). Accordingly, the mth power control signal generator 144(*m*) may add 2 (LHL), which is the compensation value CV, to 0 (LLL), which is the first reference value SV1 corresponding to the mth active area, and output 2 (LHL) as the mth power control signal PWRC (m).

Accordingly, an amplification ratio of the buffer 134 of a source driving integrated circuit SDIC is controlled depending on a power control signal PWRC to control power consumption of the buffer 134 of the SDIC.

As described above, in the driving method of a display device according to an embodiment of the present disclosure, a power control signal is generated depending on a difference value between comparison data which is the maximum data transition value between adjacent pixel rows disposed in each of a plurality of active areas and edge comparison data which is the maximum data transition value between adjacent pixel rows disposed in a plurality of edge active areas. Thus, it is possible to control the intensity of a driving current of a plurality of SDICs.

The level of data transition in an edge active area is applied to the intensity of a driving current. Thus, when data voltages for representing the same gray scale are applied to a plurality of active areas, it is possible to suppress a defect, such as a block dim, at a boundary.

In addition, in the driving method of a display device according to an embodiment of the present disclosure, it is possible to adjust the intensity of a driving current of a plurality of SDICs by using comparison data which is the maximum data transition value between adjacent pixel rows disposed in each of a plurality of active areas. Thus, it is possible to set an optimal driving current intensity for each active area.

Therefore, it is possible to determine an optimal driving power for each active area and thus optimize power consumption of the display device according to an embodiment of the present disclosure.

The embodiments of the present disclosure can also be described as follows:

According to an aspect of the present disclosure, the display device includes a display panel that is divided into a plurality of active areas. Further, the display device includes a data driver configured to supply data voltages to a plurality of pixels disposed in each of the plurality of active areas. Also, the display device includes a timing controller configured to output a power control signal for controlling a driving current provided to the data driver. Each active area is divided into a center active area where a plurality of pixel columns is disposed at a central portion among a plurality of pixel columns disposed in the active areas, and one or more edge active areas where a plurality of pixel columns is disposed at an outer portion among the plurality pixel columns disposed in the active area. The data driver includes a plurality of source driving integrated circuits (SDICs) which each supplies the data voltage to each of the plurality of active areas. The timing controller generates the power control signal depending on a difference value between comparison data which is the maximum data transition value between adjacent pixel rows disposed in each of the plurality of active areas and edge comparison data which is the maximum data transition value between adjacent pixel rows disposed in the plurality of edge active areas. Thus, it is possible to improve an image quality at a boundary between the active areas.

The timing controller may include a data enable signal generator configured to generate a sub-data enable signal configured to control an output timing of the data voltage to each of the plurality of active areas and an edge data enable signal configured to control an output timing of the data voltage to each of the plurality of edge active areas, a data delay unit configured to delay video data by one horizontal period and output the delayed video data, a data comparison unit configured to compare the video data and the delayed video data and generate the comparison data and the edge comparison data and a power control signal generator configured to generate the power control signal by using the comparison data and the edge comparison data.

The power control signal generator may set a first reference value by applying the comparison data to a first look-up table, sets a second reference value by applying the edge comparison data to a second look-up table, sets a compensation value by applying a difference value between a first reference value corresponding to an active area and a second reference value corresponding to an edge active area adjacent to the active area to a third look-up table, and adds the compensation value to the first reference value corresponding to the active area and outputs a result as the power control signal.

The edge active area may include a front edge active area adjacent to a previous active area and a back edge active area adjacent to a next active area.

The power control signal generator may set the compensation value by applying a difference value between the first reference value corresponding to the active area and a second reference value corresponding to a back edge active area of a previous active area to the third look-up table.

The power control signal generator may set the compensation value by applying a difference value between the first reference value corresponding to the active area and a second reference value corresponding to a front edge active area of a next active area to the third look-up table.

The data comparison unit may generate each of a plurality of comparison data by comparing video data and delayed video data corresponding to the plurality of active areas while the sub-data enable signal has a turn-on level.

The data comparison unit may generate each of a plurality of edge comparison data by comparing video data and delayed video data corresponding to the plurality of edge active areas while the edge data enable signal has a turn-on level.

Each of the plurality of source driving integrated circuits may include a shift register configured to determine sequential data sampling timings in response to a data control signal, a latch unit configured to sequentially align digital video data according to the data sampling timings, a digital-analog converter configured to convert the digital video data into the data voltage by using an analog gamma voltage, a buffer configured to output the data voltage to a data line and a power control circuit configured to supply a driving current to the buffer in response to the power control signal.

The power control circuit may include a plurality of current sources, a plurality of switches connected to the plurality of current sources to control the plurality of current sources, respectively and a current mirror circuit configured to output a driving current, which is determined depending on an on-state of the plurality of switches, to the buffer.

According to another aspect of the present disclosure, the driving method of a display device includes a data delay process for delaying video data by one horizontal period and outputting the delayed video data. Further, the driving method includes a data comparison process for generating comparison data and edge comparison data by comparing the video data and the delayed video data. Also, the driving method includes a first reference value setting process for setting a first reference value by applying the comparison data to a first look-up table 1st LUT. Furthermore, the driving method includes a second reference value setting process for setting a second reference value by applying the edge comparison data to a second look-up table 2nd LUT. Moreover, the driving method includes a compensation value calculation process for setting a compensation value by applying a difference value between a first reference value corresponding to an active area and a second reference value corresponding to an edge active area adjacent to the active area to a third look-up table 3rd LUT. Further, the driving method includes a power control signal output process for adding the compensation value to the first reference value corresponding to the active area and outputting a result as the power control signal.

The edge active area may include a front edge active area adjacent to a previous active area and a back edge active area adjacent to a next active area, and in the compensation value calculation process, the compensation value is set by applying a difference value between the first reference value corresponding to the active area and a second reference value corresponding to a back edge active area of a previous active area to the third look-up table.

The edge active area may include a front edge active area adjacent to a previous active area and a back edge active area adjacent to a next active area, and in the compensation value calculation process, the compensation value is set by applying a difference value between the first reference value corresponding to the active area and a second reference value corresponding to a front edge active area of a next active area to the third look-up table.

The driving method of a display device may further comprise before the data comparison process, a data enable signal generation process for generating a sub-data enable signal configured to control an output timing of the data voltage to each of the plurality of active areas and an edge data enable signal configured to determine an output timing of the data voltage to each of the plurality of edge active areas.

In the data comparison process, each of a plurality of comparison data may be generated by comparing video data and delayed video data corresponding to the plurality of active areas while the sub-data enable signal has a turn-on level.

In the data comparison process, each of a plurality of edge comparison data is generated by comparing video data and delayed video data corresponding to the plurality of edge active areas while the edge data enable signal has a turn-on level.

Although the embodiments of the present disclosure have been described in detail with reference to the accompanying drawings, the present disclosure is not limited thereto and may be embodied in many different forms without departing from the technical concept of the present disclosure. Therefore, the embodiments of the present disclosure are provided for illustrative purposes only but not intended to limit the technical concept of the present disclosure. The scope of the technical concept of the present disclosure is not limited thereto. Therefore, it should be understood that the above-described embodiments are illustrative in all aspects and do not limit the present disclosure. The protective scope of the present disclosure should be construed based on the following claims, and all the technical concepts in the equivalent scope thereof should be construed as falling within the scope of the present disclosure.

What is claimed is:

1. A display device, comprising:

a display panel comprising a plurality of active areas;

a data driver configured to supply data voltages to a plurality of pixels disposed in each of the plurality of active areas; and a timing controller configured to output to the data driver a power control signal for controlling a driving current, wherein each of the plurality of active areas comprises:

a center active area where a plurality of pixel columns is disposed at a central portion among a plurality of pixel columns disposed in the active area, and one or more edge active areas where a plurality of pixel columns is disposed at an outer portion among the plurality pixel columns disposed in the active area, wherein the data driver includes a plurality of source driving integrated circuits, each source driving integrated circuit configured to supply the data voltage to each of the plurality of active areas, and wherein the timing controller generates the power control signal depending on a difference value between comparison data and edge comparison data, wherein the comparison data is a maximum data transition value between adjacent pixel rows disposed in each of the plurality of active areas and wherein the edge comparison data is the maximum data transition value between adjacent pixel rows disposed in the plurality of edge active areas.

2. The display device according to claim 1, wherein the timing controller includes:

a data enable signal generator configured to generate a sub-data enable signal configured to control an output timing of the data voltage to each of the plurality of active areas and an edge data enable signal configured to control an output timing of the data voltage to each of the plurality of edge active areas;

a data delay unit configured to delay video data by one horizontal period and output the delayed video data;

a data comparison unit configured to compare the video data and the delayed video data and generate the comparison data and the edge comparison data; and a power control signal generator configured to generate the power control signal based on the comparison data and the edge comparison data.

3. The display device according to claim 2, wherein the power control signal generator sets a first reference value by applying the comparison data to a first look-up table, sets a second reference value by applying the edge comparison data to a second look-up table, sets a compensation value by applying a difference value between the first reference value corresponding to an active area and the second reference value corresponding to an edge active area adjacent to the active area to a third look-up table, and adds the compensation value to the first reference value corresponding to the active area and outputs a result as the power control signal.

4. The display device according to claim 3, wherein the edge active area includes a front edge active area adjacent to a previous active area and a back edge active area adjacent to a next active area.

5. The display device according to claim 4, wherein the power control signal generator sets the compensation value by applying a difference value between the first reference value corresponding to the active area and a second reference value corresponding to a back edge active area of a previous active area to the third look-up table.

6. The display device according to claim 4, wherein the power control signal generator sets the compensation value by applying a difference value between the first reference value corresponding to the active area and a second reference value corresponding to a front edge active area of a next active area to the third look-up table.

7. The display device according to claim 2, wherein the data comparison unit generates each of a plurality of comparison data by comparing video data and delayed video data corresponding to the plurality of active areas while the sub-data enable signal has a turn-on level.

8. The display device according to claim 2, wherein the data comparison unit generates each of a plurality of edge comparison data by comparing video data and delayed video data corresponding to the plurality of edge active areas while the edge data enable signal has a turn-on level.

9. The display device according to claim 1, wherein each of the plurality of source driving integrated circuits includes:

a shift register configured to determine sequential data sampling timings in response to a data control signal;

a latch unit configured to sequentially align digital video data according to the data sampling timings;

a digital-analog converter configured to convert the digital video data into the data voltage by using an analog gamma voltage;

a buffer configured to output the data voltage to a data line; and a power control circuit configured to supply a driving current to the buffer in response to the power control signal.

10. The display device according to claim 9, wherein the power control circuit includes:

a plurality of current sources;

a plurality of switches, each switch of the plurality of switches connected to a corresponding current source of the plurality of current sources to control the plurality of current sources; and a current mirror circuit configured to output a driving current to the buffer, wherein the driving current is determined depending on an on-state of the plurality of switches.

11. A method for driving a display device that includes:

a display panel comprising a plurality of active areas; and a data driver configured to supply data voltages to a plurality of pixels disposed in each of the plurality of active areas, wherein each of the plurality of active areas comprises a center active area where a plurality of pixel columns is disposed at a central portion among a plurality of pixel columns disposed in the active area and one or more edge active areas where a plurality of pixel columns is disposed at an outer portion among the plurality pixel columns disposed in the active area, and the data driver includes a plurality of source driving integrated circuits of which a driving current is controlled in response to a power signal, and the method comprising:

delaying video data by one horizontal period and outputting the delayed video data;

generating comparison data and edge comparison data by comparing the video data and the delayed video data;

setting a first reference value by applying the comparison data to a first look-up table;

setting a second reference value by applying the edge comparison data to a second look-up table;

setting a compensation value by applying a difference value between the first reference value corresponding to an active area and the second reference value corresponding to an edge active area adjacent to the active area to a third look-up table; and adding the compensation value to the first reference value corresponding to the active area and outputting a result as a power control signal.

12. The method according to claim 11, wherein the edge active area includes a front edge active area adjacent to a previous active area and a back edge active area adjacent to a next active area, and wherein the second reference value corresponds to a back edge active area of a previous active area to the third look-up table.

13. The method according to claim 11, wherein the edge active area includes a front edge active area adjacent to a previous active area and a back edge active area adjacent to a next active area, and wherein the second reference value corresponds to a front edge active area of a next active area to the third look-up table.

14. The method according to claim 11, further comprising:

generating a sub-data enable signal configured to control an output timing of the data voltage to each of a plurality of active areas and an edge data enable signal configured to control an output timing of the data voltage to each of a plurality of edge active areas.

15. The method according to claim 14, wherein each of a plurality of comparison data is generated by comparing video data and delayed video data corresponding to the plurality of active areas while the sub-data enable signal has a turn-on level.

16. The method according to claim 14, wherein each of a plurality of edge comparison data is generated by comparing video data and delayed video data corresponding to the plurality of edge active areas while the edge data enable signal has a turn-on level.

17. A display device comprising:

a display panel comprising a plurality of active areas, each active area of the plurality of active areas including a center active area and one or more edge active areas adjacent to the center active area;

a data comparator configured to generate comparison data by comparing data values between adjacent pixel rows in each of the plurality of active areas, and edge comparison data by comparing data values between adjacent pixel rows in each edge active area of the plurality of active areas;

a power control signal generator configured to generate the power control signal based on the comparison data and the edge comparison data; and a data driver configured to generate data voltages according to the power control signal.

18. The display device of claim 17, wherein the power control signal generator is configured to generate the power control signal by setting a first reference value by applying the comparison data to a first look-up table, setting a second reference value by applying the edge comparison data to a second look-up table, and setting a compensation value by applying a difference value between the first reference value and the second reference value.

19. The display device of claim 18, wherein the first reference voltage corresponds to an active area, and the second reference voltage corresponds to an edge active area adjacent to the active area.

20. The display device of claim 18, wherein the data driver comprises a power control circuit comprising:

a plurality of current sources;

a plurality of switches, each switch of the plurality of switches connected to a corresponding current source of the plurality of current sources, the plurality of switches controlled by the power control signal; and a current mirror circuit coupled to the plurality of switches, the current mirror circuit configured to output a driving current based on an on-state of each switch of the plurality of switches.

* * * * *